US009505504B2

(12) United States Patent
Murray et al.

(10) Patent No.: US 9,505,504 B2
(45) Date of Patent: Nov. 29, 2016

(54) APPARATUS FOR THE TWO STAGE FILLING OF FLEXIBLE POUCHES

(75) Inventors: R. Charles Murray, Sarasota, FL (US); Olaf Clemens, Wipperfurth (DE)

(73) Assignees: Pouch Pac Innovations, LLC, Sarasota, FL (US); SN Maschinenbau GmbH, Wipperfurth (DE)

( * ) Notice: Subject to any disclaimer, the term of this patent is extended or adjusted under 35 U.S.C. 154(b) by 1165 days.

(21) Appl. No.: 13/401,274

(22) Filed: Feb. 21, 2012

(65) Prior Publication Data

US 2012/0210675 A1 Aug. 23, 2012

Related U.S. Application Data

(60) Provisional application No. 61/444,363, filed on Feb. 18, 2011, provisional application No. 61/485,529, filed on May 12, 2011.

(51) Int. Cl.

| | |
|---|---|
| ***B65B 31/04*** | (2006.01) |
| ***B65B 1/28*** | (2006.01) |
| ***B65B 43/36*** | (2006.01) |
| ***B65B 43/46*** | (2006.01) |
| ***B65B 43/56*** | (2006.01) |
| ***B65B 43/60*** | (2006.01) |
| ***B65B 1/12*** | (2006.01) |
| ***B65B 1/34*** | (2006.01) |

(52) U.S. Cl.

CPC . *B65B 1/28* (2013.01); *B65B 1/12* (2013.01); *B65B 1/34* (2013.01); *B65B 31/042* (2013.01); *B65B 43/36* (2013.01); *B65B 43/465* (2013.01); *B65B 43/56* (2013.01); *B65B 43/60* (2013.01)

(58) Field of Classification Search

CPC ..... B65B 31/042; B65B 31/04; B65B 43/36; B65B 43/465; B65B 43/50; B65B 43/60; B65B 43/56; B65B 1/28; B65B 1/30; B65B 1/34; B65B 1/12; B65B 31/06

USPC ..... 53/434, 512, 403, 240, 432; 141/63, 47, 141/57, 91, 92, 166

See application file for complete search history.

(56) References Cited

U.S. PATENT DOCUMENTS

| | | | | |
|---|---|---|---|---|
| 2,506,769 | A * | 5/1950 | Bergstein | 53/432 |
| 2,898,953 | A * | 8/1959 | Berthelsen et al. | 141/48 |
| 3,376,690 | A * | 4/1968 | Jianas | B65B 31/06 53/512 |
| 3,942,301 | A * | 3/1976 | Domke | B65B 31/042 53/110 |
| 4,033,093 | A * | 7/1977 | Mencacci | B65B 31/04 141/264 |
| 4,221,101 | A * | 9/1980 | Woods | B65B 31/06 53/512 |
| 4,262,708 | A * | 4/1981 | de Echeandia et al. | 141/7 |
| 4,312,171 | A * | 1/1982 | Vadas | 53/403 |
| 4,326,568 | A | 4/1982 | Burton et al. | |

(Continued)

*Primary Examiner* — Stephen F Gerrity

(74) *Attorney, Agent, or Firm* — Dinsmore & Shohl LLP

(57) ABSTRACT

The apparatus, for filling a flexible pouch having a bottom end, an opposite top end, and a pair of side edges extending between the bottom and top end, includes a filling station, a supply of compressed purging gas, and a gas purging station. The filling station includes a feeder that dispenses an amount of product into the pouch. The gas purge station is positioned subsequent to the filling station and includes a pair of gas lances. Each of the pair of gas lances have an outlet to discharge the purging gas into the pouch. The pair of gas lances being moveable between an inserted position and a withdrawn position. In the inserted position the pair of gas lances are disposed within the pouch a predetermined distance above the amount of product, and in the withdrawn position the pair of gas lances are provided above the top end of the pouch.

20 Claims, 10 Drawing Sheets

(56) References Cited

U.S. PATENT DOCUMENTS

| | | | | |
|---|---|---|---|---|
| 4,848,421 | A | 7/1989 | Froese et al. | |
| 4,999,978 | A | 3/1991 | Kohlbach et al. | |
| 5,267,591 | A | 12/1993 | Wakabayashi et al. | |
| 5,485,714 | A | 1/1996 | Montalvo | |
| 5,561,964 | A * | 10/1996 | McIntyre | B65B 31/06 219/667 |
| 5,664,408 | A * | 9/1997 | Chesterfield | B65B 31/06 53/512 |
| 5,715,874 | A * | 2/1998 | Reynolds et al. | 141/2 |
| 6,199,601 | B1 | 3/2001 | Laudenberg | |
| 7,198,206 | B2 * | 4/2007 | Soria et al. | 239/532 |
| 2006/0213153 | A1 * | 9/2006 | Sanfilippo et al. | 53/511 |
| 2007/0074492 | A1 * | 4/2007 | Koga et al. | 53/512 |
| 2012/0279180 | A1 * | 11/2012 | Crawford et al. | 53/432 |

* cited by examiner

APPARATUS FOR THE TWO STAGE FILLING OF FLEXIBLE POUCHES

CROSS-REFERENCE TO RELATED APPLICATIONS

This application claims priority of U.S. Provisional Patent Application Ser. No. 61/444,363 filed Feb. 18, 2011, and U.S. Provisional Patent Application Ser. No. 61/485,529 filed May 12, 2011, both of which are incorporated herein by reference.

FIELD OF THE INVENTION

The present invention relates generally to an apparatus and method for purging residual amounts of oxygen from an interior of a flexible pouch and, more particularly, to an apparatus and method in which the pouch is filled in a two stage operation.

BACKGROUND OF THE INVENTION

Flexible pouches formed of a plastic or foil are used to package a variety of products including consumable liquids and other edible products. In order to extend the shelf life of the package, the liquid and/or other products must be packaged in the absence of oxygen. The presence of oxygen in the filled pouch increases the chance of bacteria forming, or may affect the taste. Previously known packaging systems included a pre-filling purging station, a filling station, and a post-filling purging station. In the pre-filling purge station and the post-filling purge station, a purging gas such as carbon dioxide ($CO_2$) or nitrogen ($N_2$) is directed into the pouch at a high pressure. However, due to the high pressure of the purging gas, residual amounts of oxygen remain within the pouch due to the turbulent mixing of the oxygen with the purging gas. These residual amounts of oxygen remaining in the pouch considerably shorten the shelf life of the packaged product.

In addition, when the flexible pouches are filled with a product that is a particulate, such as powdered cheese, powdered drink mixes or the like, it is difficult to accurately fill the pouch with the correct amount of product. Specifically, the calibration required by a feeder so as to be able to dispense a precise amount of product is difficult to maintain at high speed fillings. Further, as the product is a particulate such as a powdered product, a portion of the amount dispensed typically remains airborne and does not enter the pouch.

It is therefore an objective of this invention to provide an apparatus and method which thoroughly purges the oxygen in a flexible pouch, and accurately fills the pouch with a particulate product.

SUMMARY OF THE INVENTION

The present invention provides an apparatus for filling a flexible pouch, the apparatus having a gas purge station which overcomes the above-mentioned disadvantages of the previously known machines by removing an increased amount of residual oxygen from the interior of the pouch after filling, and accurately fills the pouch.

In brief, the apparatus is provided for filling a flexible pouch having a bottom end, an opposite top end, and a pair of side edges extending between the bottom end and the top end. The apparatus includes a filling station, a supply of compressed purging gas, and a gas purging station. The filling station includes a feeder that dispenses an amount of product into the pouch. The gas purge station is positioned subsequent to the filling station and includes a pair of gas lances. Each of the pair of gas lances have an outlet at a distal end to discharge the purging gas into the pouch. The pair of gas lances being reciprocatingly moveable between an inserted position and a withdrawn position. In the inserted position the pair of gas lances are disposed within the pouch a predetermined distance above the amount of product, and in the withdrawn position the pair of gas lances are provided above the top end of the pouch.

The pair of gas lances extend parallel and are spaced apart a distance less than the distance between the pair of side edges of the pouch, such that in the inserted position each one of the pair of gas lances is disposed adjacent one of the pair of the pair of side edges of the pouch. By providing a pair of gas lances that extending parallel to and adjacent with the side edges of the pouch, residual amounts of oxygen can be removed as the pair of gas lances in the inserted position are disposed between one of the side edges of the pouch and an apex of the amount of product.

The purging station further includes a gas regulator that regulates the pressure of the compressed purging gas discharged by the pair of gas lances. Upon movement from the withdrawn position to the inserted position, the pair of gas lances discharge a descent pressure, and upon movement from the inserted position to the withdrawn position the pair of gas lances discharge an ascent pressure. The ascent pressure is regulated so as to be reduced as the pair of gas lances move from the inserted position to the withdrawn position.

The apparatus further includes a second filling station and a second gas purging station. The second filling station being positioned subsequent to the gas purging station and includes a second feeder that dispenses a second amount of product into the pouch. The second gas purging station is positioned subsequent to the second filling station and includes a second pair of gas lances. Each of the second pair of gas lances have an outlet at a distal end to discharge the purging gas into the pouch. The second pair of gas lances being reciprocatingly moveable between an inserted position and a withdrawn position. In the inserted position the second pair of gas lances are disposed within the pouch a predetermined distance above the second amount of product, and in the withdrawn position the second pair of gas lances are provided above the top end of the pouch.

The second pair of gas lances extend parallel and are spaced apart a distance less than the distance between the pair of side edges of the pouch, such that in the inserted position each one of the second pair of gas lances is disposed adjacent one of the pair of the pair of side edges of the pouch. By providing a second filling station and a second purging station having a second pair of gas lances that extending parallel to and adjacent with the side edges of the pouch, residual amounts of oxygen can be removed due to the two stage filling and gas purging subsequent to each filling operation. As the second pair of gas lances in the inserted position are disposed between one of the side edges of the pouch and an apex of the second amount of product.

The second purging station further includes a second gas regulator that regulates the pressure of the compressed purging gas discharged by the second pair of gas lances. Upon movement from the withdrawn position to the inserted position, the second pair of gas lances discharge a second descent pressure, and upon movement from the inserted position to the withdrawn position the pair of gas lances discharge a second ascent pressure. The second ascent pressure is regulated so as to be reduced as the second pair of gas lances move from the inserted position to the withdrawn position.

In an alternative embodiment, the apparatus for filling a flexible pouch with a particulate product includes a first filling station, a second filling station, a controller in communication with the second filling station, and a weighing station in communication with the controller. The first filling station includes a first filler that dispenses a first amount of product to at least partially fill the pouch. The second filling station includes a second filler that dispenses a second amount of product into the pouch. The weighing station is positioned between the first filling station and the second filling station and includes a scale that weighs the pouch to determine a weight of the first amount of product. The controller receives the determined weight of the first amount of product and compares the determined weight of the first amount of product to a predetermined weight to determine a remaining amount of product. The controller transmits the remaining amount of product to the second filling station, and the second filling station uses the remaining amount of product as the second amount of product.

BRIEF DESCRIPTION OF THE DRAWINGS

A better understanding of the present invention will be had upon reference to the following detailed description when read in conjunction with the accompanying drawings wherein like reference characters refer to like parts through the several views and in which.

DETAILED DESCRIPTION OF THE INVENTION

The present invention has utility as an apparatus for filling a flexible pouch with a product while reducing the amount of residual oxygen remaining in the pouch after filling and prior to the sealing of the top end of the pouch. By providing a gas purging station positioned subsequent to a filling station, and that includes a pair of gas lances reciprocatingly moveable between an inserted position and a withdrawn position to discharge a compressed purging gas reduces the residual amount of oxygen remaining within the pouch. Further, by providing the pair of gas lances to extend parallel and spaced apart to as to extend adjacent to the side edges of the pouch when the pair of gas lances are in the inserted positions allows the gas purging station to purge additional amounts of residual oxygen. Moreover, by separating the filling operation into a first filling and a second filling with a first purging between the first filling and the second filling, and a second purging subsequent to the second filling allows additional amounts of residual oxygen to be removed that would otherwise be trapped within the product.

Figure 1:
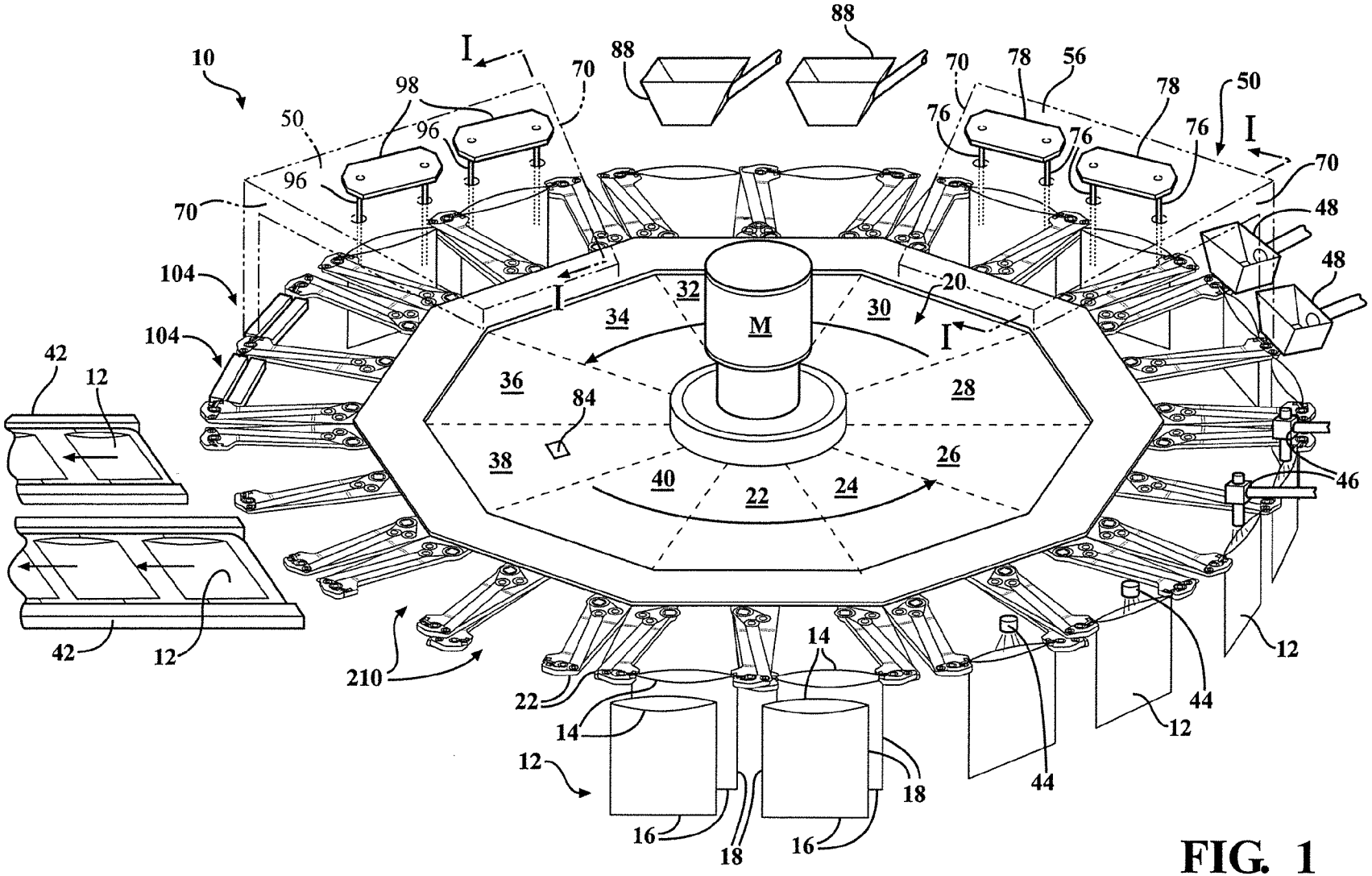
FIG. 1 is a perspective schematic view of a fill-seal apparatus in accordance with the invention.
Figure 2:
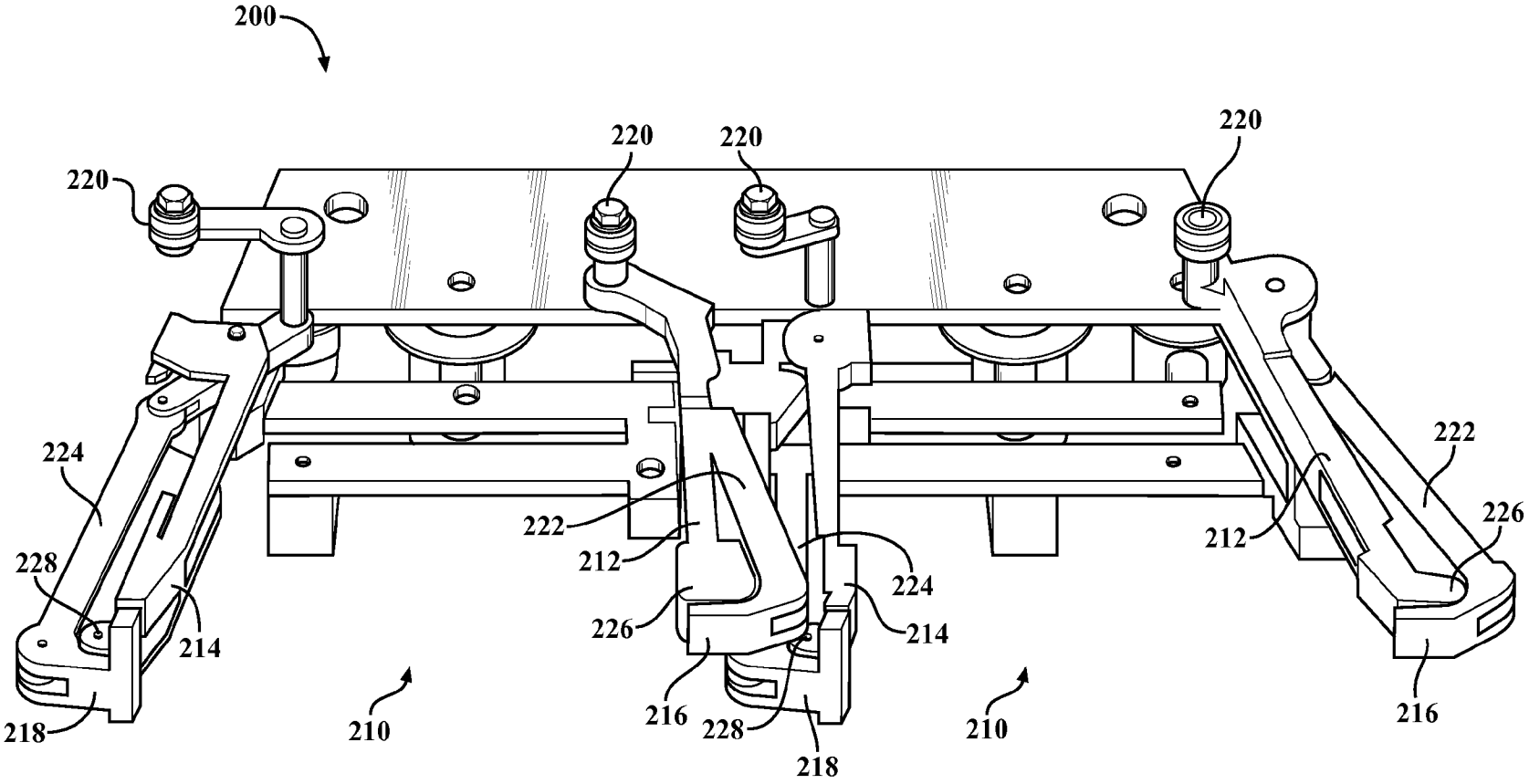
FIG. 2 is a perspective view illustrating a gripper for gripping the pouch.

With reference to FIG. 1, an apparatus for filling and sealing flexible pouches is generally illustrated at 10. The apparatus 10 is particularly adapted for consumable products including edible dry products such as powders, chips, dog food, shredded cheese, or liquid products such as juice, carbonated beverages, and alcoholic beverages. However, it is appreciated, of course, that the use of the two stage filling is not limited to consumable products.

The apparatus 10 is configured to fill and seal a variety of pouches 12 having a variety of different shapes. The flexible pouch 10 is preferably formed from a roll of preprinted material of extruded or laminate layers. The material is typically a three, or four, or five or more gauge material or multiple laminations of material or the like. The outer layer is usually preprinted. Alternatively, at least a portion of the material may be not printed, i.e. translucent, in order to view the contents contained therein. The clear portion could also be in a gusset or insert. The outer layer may include preprinted information, as with a label or shrink sleeve. The pouch 12 is optionally formed of more than one type of material. The choice of sheet layer material is non-limiting, and is influenced by factors such as the product contained in the pouch 12, the shape of the pouch 12, or the anticipated use of the pouch 12.

The pouches 12 include a top end 14, an opposite bottom end 16, and a pair of sides 18 extending between the top end 14 and the bottom end 16. It is appreciated, of course, that the flexible pouches 12 may be formed from a single piece of material or two separate panels sealed together to form the pouch. In addition, the flexible pouches 12 may include a variety of additional features including bottom or side gussets, fitments, and resealable zip type openings. The top end 14 of each of the flexible pouches 12 defines an opening for filling. In an example of pouches 12 formed using two sheets of material, the side edges 18 may be joined along two side seams, such as flat seam or a fin style seam, extending from the top end 14 to the bottom end 16.

As shown in FIG. 1, the apparatus 10 is a rotary fill-seal machine having a rotating turret 20 which is sequentially rotated in a counterclockwise direction through each of a plurality of sectors or stations by a motor M. It is appreciated of course, that although the illustrated embodiment depicts the apparatus for filling and sealing the flexible pouches 12 as a rotary machine, the invention is not limited to such a configuration and is optionally a linear type fill-seal machine. Moreover, the invention is not limited to a fill-seal configuration, and is optionally a fill machine in which the pouches 12 are transferred to a separate machine for sealing.

The rotating turret 20 rotates through ten stations in which the apparatus 10 performs an operation on multiple pouches 12 simultaneously. The rotating turret 20 of the apparatus 10 includes a loading station 22, a first opening station 24, a second opening station 26, a first filling station 28, a first gas purging station 30, a second filling station 32, a second gas purging station 34, a top seal station 36, an unloading station 38, and a maintenance/reject station 40. Each of the stations 22 through 40 applies a specific operation on multiple pouches 12, and after completion of the operation, the motor M rotates the pouches 12 to the subsequent station.

Each of the gripper pairs 210 includes a regular gripper arm 212 and an offset gripper arm 214. In order to reduce the width of the gripper cassette 210, the internal gripper arms are configured such that the offset gripper arms 214 are positioned below the regular gripper arms 212 of the adjacent gripper pair 210. Each of the regular gripper arms 212 and offset gripper arms 214 includes fingers that secure the pouch 12, specifically, the side edges 18, into the gripper pairs 210.

Each of the gripper pairs 210 includes a regular gripper arm 212 and an offset gripper arm 214. In order to reduce the width of the gripper cassette 210, the internal gripper arms are configured such that the offset gripper arms 214 are positioned below the regular gripper arms 212 of the adjacent gripper pair 210. Each of the regular gripper arms 212 and offset gripper arms 214 includes fingers that secure the pouch 12, specifically, the side edges 28, into the gripper pairs 210.

Specifically, the regular gripper arms 212 are provided with regular gripper fingers 216 attached to regular link mechanism 222 and the offset gripper arms 214 are provided with offset gripper fingers 218 attached to offset link mechanisms 224 which extend at least partially above the offset gripper arm 214. The offset gripper fingers 218 allow for the upper most edge of both the regular gripper fingers 216 and the offset gripper fingers 218 to be a predetermined distance from the top end 14 of the pouches 12. Each of the gripper pairs 210 include regular link mechanisms 222 and offset link mechanisms 224 which are actuated by cams 220 to actuate the regular gripper finders 216 and the offset gripper finders 218. The regular link mechanisms 222 connect to the distal ends of the regular gripper arms 212 about pivot points 226, and the offset link mechanisms 224 connect to the distal ends of the offset gripper arms 214 about pivot points 228.

At the loading station 22 of the rotating turret 20, the gripper arms 212 and the offset gripper arms 214 are actuated by cams 220 during rotation of the rotating turret 20 push and pull the regular link mechanisms 222 and the offset link mechanisms 224 to open and close the regular gripper fingers 216 and the offset gripper fingers 218. The cams 220 are actuated so that the gripper fingers 216 and the offset gripper fingers 218 are pivoted about pivot points 226 and 228, respectively, into the open position to receive the pouches 12 from a by a pouch delivery device (not shown), such as a robotic transfer device, conveyor belt, manual insertion, or an overhead transfer clamp. The cams 220 are actuated to close the regular gripper fingers 216 and the offset gripper fingers 218 to secure the pouches 12 at the loading station 22. It is appreciated that the regular gripper fingers 216 and the offset gripper fingers 218 are optionally spring loaded so as to be biased towards a closed position. The rotating turret 20 actuates the cams 220 at the unloading station 38 to discharge the filled and sealed pouches 12 onto a transfer mechanism 42 for packaging and transportation.

It is appreciated, of course, that each gripper cassette 200 is independently dischargeable from the rotating turret 20 allowing for easy maintenance and repair on individual gripper cassettes 200 including the gripper pairs 210. Specifically, maintenance/repair station 40 is the repair/maintenance station which allows for an assembly team member to discharge the gripper cassette 200 from the rotating turret 20 without interfering from the various operations of the fill-seal apparatus 10. In addition, the individual gripper cassettes 200 can be replaced entirely to reduce the amount of down or repair time on the fill-seal apparatus 10.

With reference to FIG. 1, at the loading station 22 empty pouches 12 are delivered to the gripper pairs 210 by a pouch delivery device (not shown), such as a robotic transfer device, conveyor belt, manual insertion, or an overhead transfer clamp. Upon loading of the pouches 12 into the gripper pairs 210 of the pouch loading station 22, the motor M rotates the rotating turret 20 thereby moving the gripper pairs 210 to the first opening station 24. The first opening station 24 uses a conventional opening device such as a gas knife 44 positioned above the top end 14 of each of the pouches 12. The gas knife 44 is connected to a gas supply such as nitrogen, $CO_2$, or compressed gas or air. The gas knife 44 directs gas downwardly against the top ends 14 of the pouches 12 to assist in the opening of the pouches 12 as the gripper pairs 210 move together in order to open the top ends 14 of the pouches 12.

Figure 3A:
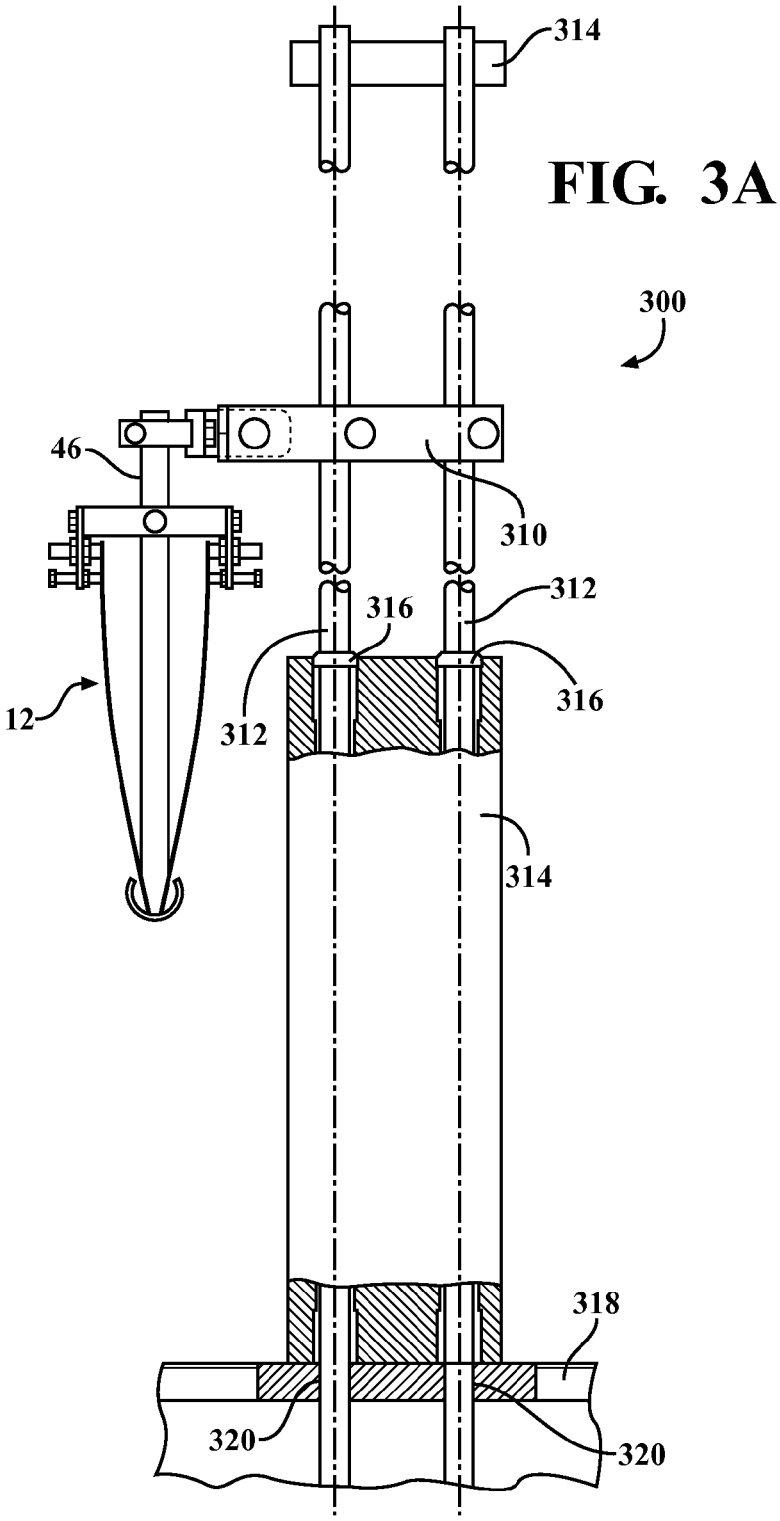
FIG. 3A is a side elevational view of the dive nozzle.
Figure 4:
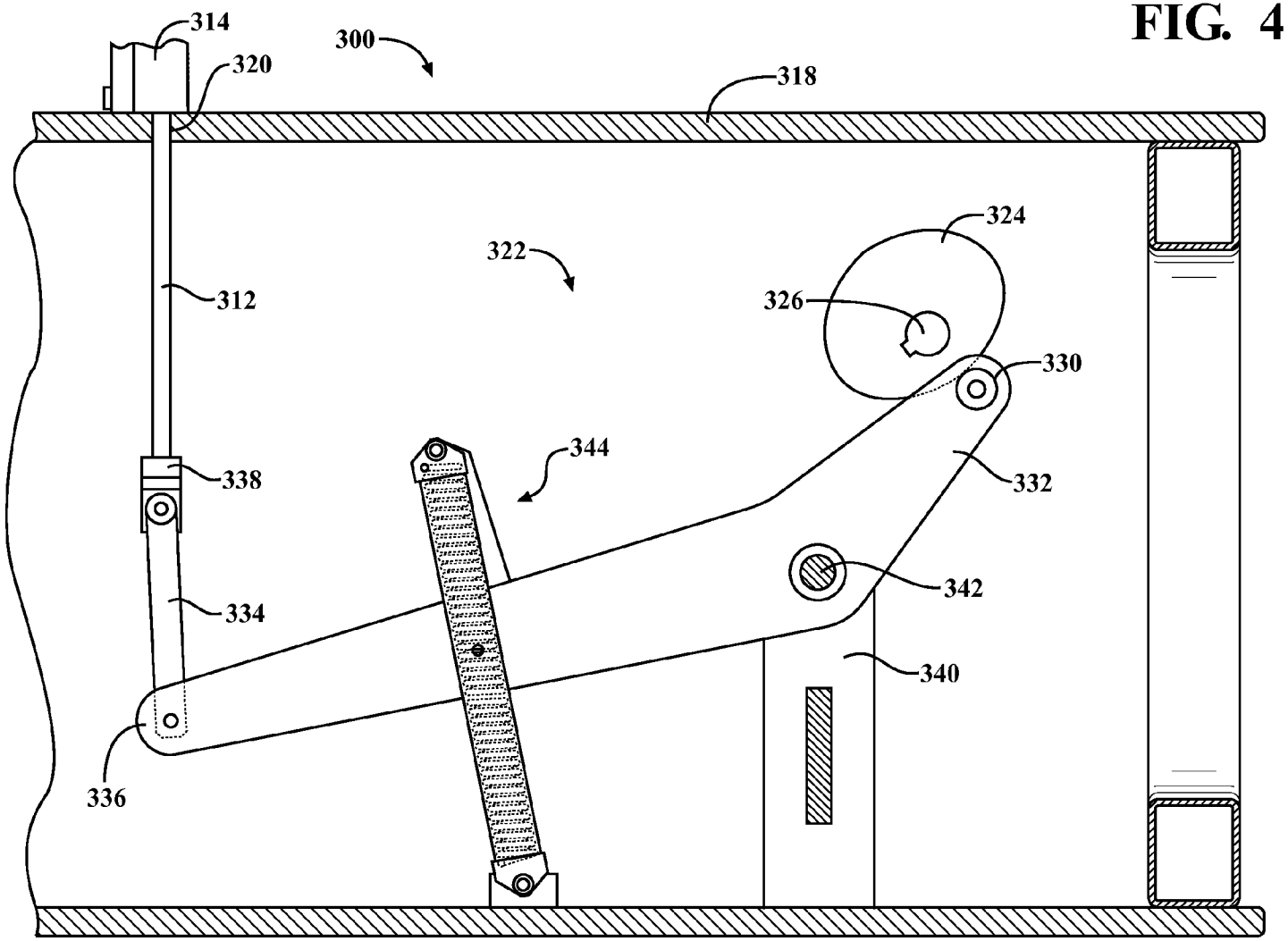
FIG. 4 is a side view of the vertical lifting mechanism of the diving nozzle.
Figure 5:
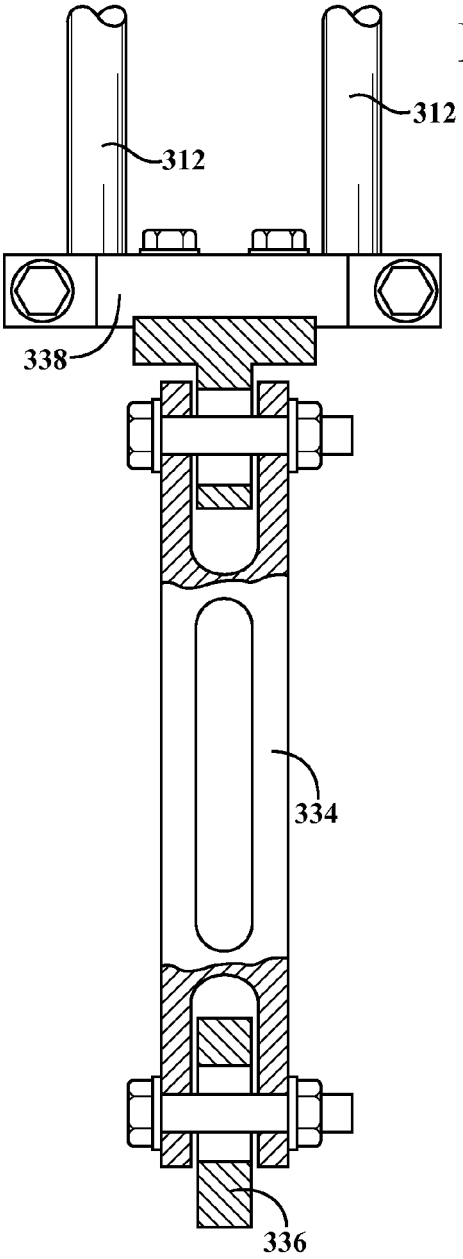
FIG. 5 is a front partial elevational view of the vertical lifting mechanism.
Figure 6:
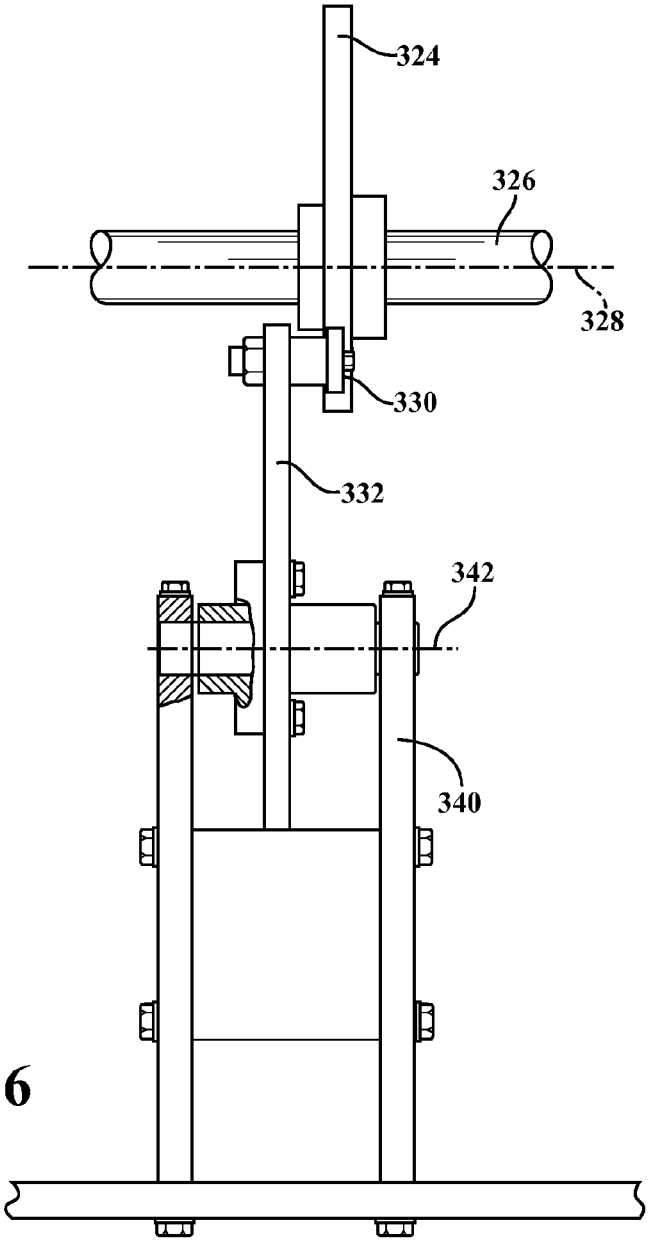
FIG. 6 is a rear partial elevational view of the vertical lifting mechanism

Upon completion of the first opening operation, the motor M rotates the rotating turret to rotate the pouches 12 within the gripper pairs 210 to the second opening station 26. The second opening station 26 includes a diving nozzle 46 positioned above the top end 14 of each pouch 12. The diving nozzle 46 enters the open top end 14 of the pouch 12 to fully open the area adjacent the bottom end 16, such as a bottom gusset. The diving nozzle 46 is reciprocatingly moveable between an inserted position, as seen in FIG. 3A and a withdrawn position, as seen in FIG. 1, by a vertical lifting mechanism 300, as seen in FIG. 4. In the inserted position the diving nozzle 46 is positioned within the interior of the pouch 12 so as to open the bottom portion of the pouch 12, and in the withdrawn position the diving nozzle 46 is positioned above the top end 14 of the pouch 12 so as to allow rotation of the rotating turret 20.

Figure 3B:
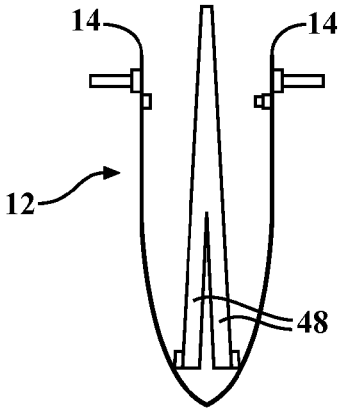
FIG. 3B is an enlarged partial side view of the dive nozzle in the expanded position.

In addition, the diving nozzle 46 is optionally connected to a gas supply and directs a supply of compressed gas to fully open the pouch 12 and/or initially purge the oxygen from the pouch 12. In the alternative, the diving nozzle 46 includes moveable fingers 48 which expand to open the bottom end 16 of the pouch 12, as seen in FIG. 3B. The diving nozzle 46 optionally includes sensors, in communication with a CPU, that indicate contact with the inside of the pouch 12 to verify to the CPU that the pouch 12 has been opened and allow the motor M to rotate the turret 20 and move the pouches 12 in the grippers to the next station.

With reference to FIGS. 3A and 4-6, the lifting mechanism 300 will be described in greater detail. The dive nozzle 46 connects to a holder 310 attached to a pair of rods 312 which are in sliding engagement with a guide 314. The guide 314 includes bearings 316 to allow for the sliding engagement of the pair of rods 312 with the guide 314. The guide 314 is attached to a base 318 having a pair of apertures 320 through which the pair of rods 312 are positioned so as to extend through the base 318.

As best seen in FIG. 4, the vertical lifting mechanism 300 includes a cam mechanism 322 positioned below the base 318. The cam mechanism 322 operates to vertically descend and ascend the diving nozzle 46 into and out of the pouch 12, specifically, the pair of rods 312. The cam mechanism 322 includes a rotating cam disc 324 that is rotated by a rotating shaft 326 that rotates about a center axis 328. The rotation of the shaft 326 rotates the cam 324 which displaces a roller 330 disposed at one end of a lever 332. The lever 332 has a yoke 334 pivotally attached to a distal end 336. The yoke 334 connects the distal end 336 of the lever 332 to a proximate end 338 of the pair of rods 312. The lever 332 is pivotally connected to a post 340 about a pivot point 342 between the roller 330 and the distal end 336.

A spring mechanism 344 is attached to the lever 332 to bias the distal end 336 of the lever 332 away from the base 318. The biasing of the distal end 336 of the lever 332 away from the base 318 biases the pair of rods 312 and consequentially the diving nozzle 46 in the inserted position. Upon rotation of roller 330 due to the rotation of the cam disc 324, the lever 332 pivots about the pivot point 342 to vertically displace the yoke 334, thereby ascending or descending the diving nozzle 38 into the pouch 12. The spring mechanism 344 will then bias the lever 332 back to the initial position upon further rotation of the cam disc 324.

After the retraction of the diving nozzles 46, that is movement of the diving nozzle 46 from the inserted position to the withdrawn position, the pouches 12 within the gripper pairs 210 are rotated to the first filling station 28 by rotation of the rotating turret 20 by the motor M. At the first filling station 28, the fully opened pouches 12 are positioned underneath a first feeder 48. The first feeder 48 dispenses a first amount of product into the pouches 12. After receiving the first amount of product from the first feeder 48, the pouches 12 within the gripper pairs 210 are rotated to the first purging station 30 by rotation of the rotating turret 20 by the motor M.

Figure 7:
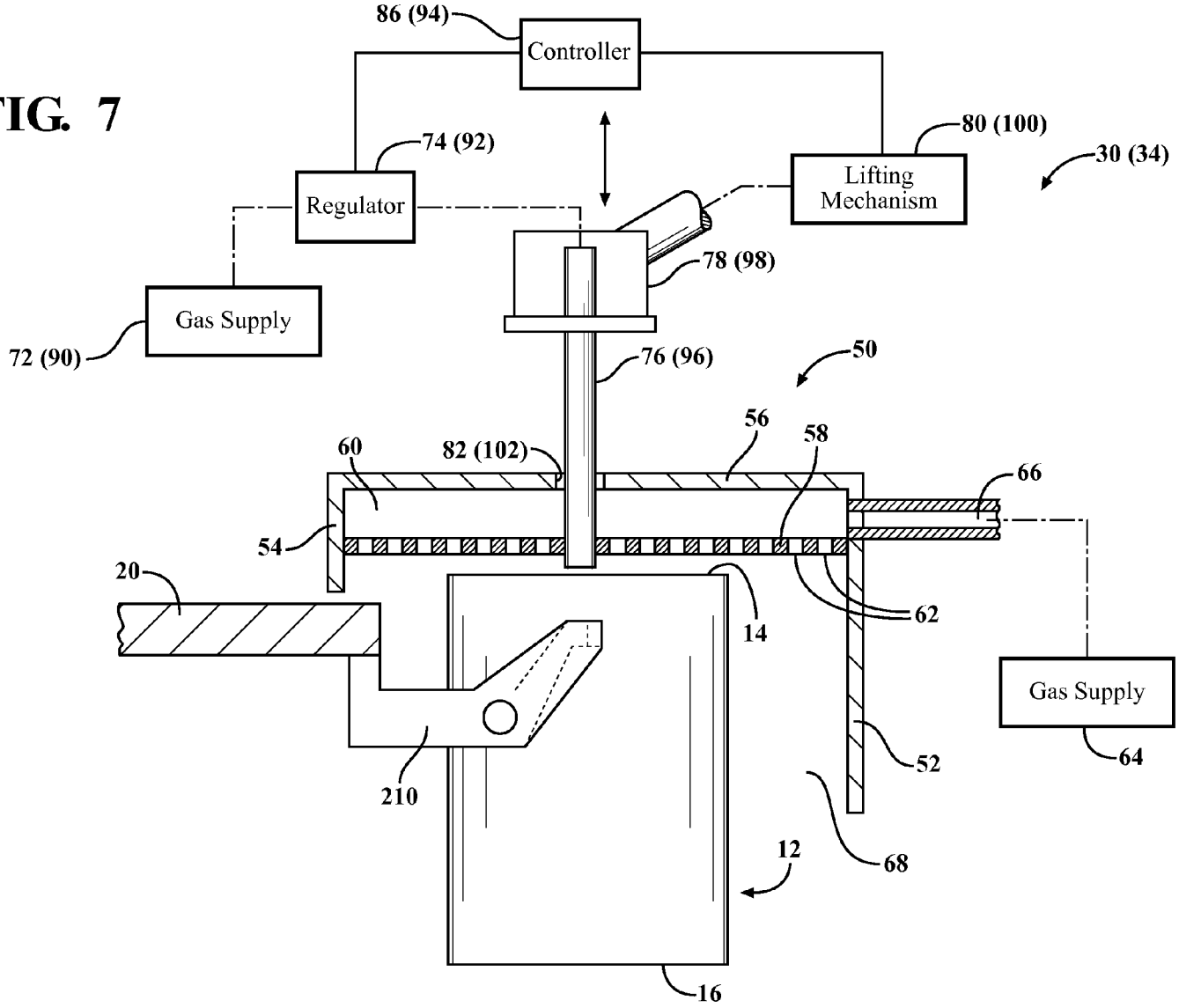
FIG. 7 is a partial cross-sectional view taken along line I-I of FIG. 1.

With reference to FIGS. 1 and 7, the first purging station 30 will now be discussed. A hood 50 is positioned over the first purging station 30. The hood 50 is provided separate from the rotating turret 20 and as such does not rotate with the pouches 12. The hood 50 includes an outer wall 52 and an inner wall 54 both of which extend coextensively downwardly from an upper wall 56. The outer wall 52 extends downwardly to a position below the gripper pair 210 and the inner wall 54 extends to slightly above the gripper pair 210. A dispersion screen 58 extends between the inner wall 54 and the outer wall 52 below the upper wall 56 to form a chamber 60. The dispersion screen 58 includes a plurality of perforations 62. The chamber 60 is in communication with a gas supply 64 through inlet 66 such that the perforations 62 form a plurality of jets of gas which disperse around the top end 14 of the pouch 12 to form a curtain thereby preventing oxygen from outside of the hood 50 from entering the pouch 12.

The perforations 62 have a diameter sufficient to form the curtain, for example, approximately ⅛ inch diameter for a pressure of less than 1 pound per square inch. The inner wall 54 and the outer wall 52 are spaced apart a sufficient distance to form a passageway 68 between a pair of end walls 70 disposed at either end of the first purging station 30. The end walls 70 extend vertically downward from the upper wall 56 to the dispersion screen 58 and partially down the inner wall 54 and the outer wall 52 to enclose the chamber 60.

The first purging station 30 includes gas supply 72 having a supply of compressed purging gas. The purging gas is optionally as nitrogen ($N_2$) or carbon dioxide ($CO_2$), although other gases operable to purge oxygen remaining in the pouch 12 and avoid spoilage of the product are applicable. A first regulator 74 is connected to the gas supply 72 so as to regulate the discharge pressure of the purging gas.

Figures 8A, 8B, 8C, 8D:
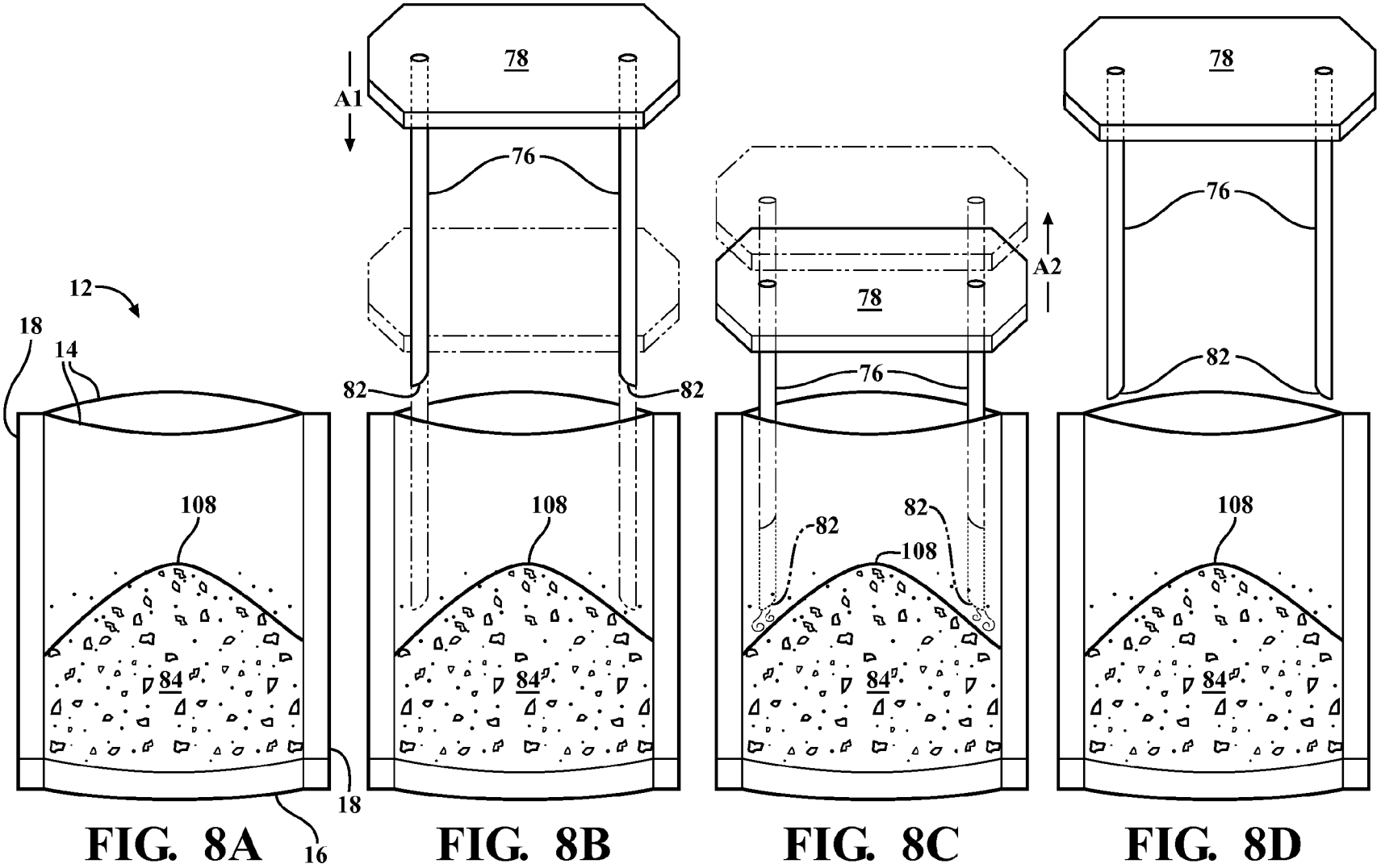
FIGS. 8A-8D are front elevational views of the first filling and first gas purging operations.

A first pair of gas lances 76 are connected to a carrier 78 which is attached to a vertical lifting mechanism 80. The vertical lifting mechanism 80 is optionally configured as the vertical lifting mechanism 300. The first pair of gas lances 76 having one end attached to the carrier 78 and operatively connected to the gas supply 72. An opposite distal end includes an outlet 82 to discharge the purging gas into the interior of the pouches 12. The vertical lifting mechanism 80 reciprocatingly moves the first pair of gas lances 76 between an inserted position, as best seen in FIG. 8C and a withdrawn position as best seen in FIGS. 7 and 8D. An aperture is provided in the hood 50 to allow for the first pair of gas lances 76 to descend into the pouches 12.

In the inserted position the outlets 82 are positioned a predetermined distance above the first amount of product 84, and in the withdrawn position the outlets 82 of the first pair of gas lances 76 are positioned above the top end 14 of the pouches 12. A controller 86 in communication with the vertical lifting mechanism 80 controls the discharge pressure of the purging gas relative to the position of the first pair of gas lances 76 and the pouch 12.

Upon rotation of the pouches 12 into the first gas purging station 30, the first pair of gas lances 76 are positioned above the top end 14 of the pouches 12 in the withdrawn position. The first pair of nozzles 76 descend into the pouch 12 to the inserted position and ascend back to the withdrawn position while performing a purging operation, described in greater detail below. After the purging operation is completed, with the first pair of gas lances 76 in the withdrawn position, the rotating turret 20 rotates moving the pouches 12 to the second filling station 32.

At the second filling station 32, the partially filled and purged pouches 12 are positioned underneath a second feeder 88. The second feeder 88 dispenses a second amount of product into the pouches 12. The second amount of product being the remainder of the product 84 needed to fully fill the pouches 12. After receiving the second amount of product from the second feeder 88, the pouches 12 within the gripper pairs 210 are rotated to the second purging station 34 by rotation of the rotating turret 20 by the motor M.

With reference to FIG. 7, the second purging station 34 includes a hood 50 similar to the hood 50 provided over the first purging station 30. The second purging station 34 includes a second gas supply 90 having a supply of compressed purging gas. The second gas supply 90 is optionally the gas supply 72 or a separate gas supply. The second purging gas is optionally the same as the purging gas contained in the gas supply 72 or a different type of purging gas. For example, both the gas supply 72 and the second gas supply 90 include nitrogen ($N_2$) or carbon dioxide ($CO_2$), or in the alternative the gas supply 72 includes one of nitrogen ($N_2$) or carbon dioxide ($CO_2$) while the second gas supply 90 includes the other of nitrogen ($N_2$) or carbon dioxide ($CO_2$). The second gas supply 90 includes a second regulator 72 so as to regulate the discharge pressure of the purging gas at the second purging station 34.

The second purging station includes a second pair of gas lances 96 attached to a second carrier 98. The second carrier is attached to a second vertical lifting mechanism 100. It is appreciated, of course, that the second vertical lifting mechanism 100 is optionally configured as the vertical lifting mechanism 300. The second pair of gas lances 96 having one end attached to the second carrier 98 and operatively connected to the second gas supply 90. A distal end of the second pair of gas lances 96 includes an outlet 102 to discharge the purging gas into the interior of the pouches 12.

Figures 9A, 9B, 9C, 9D:
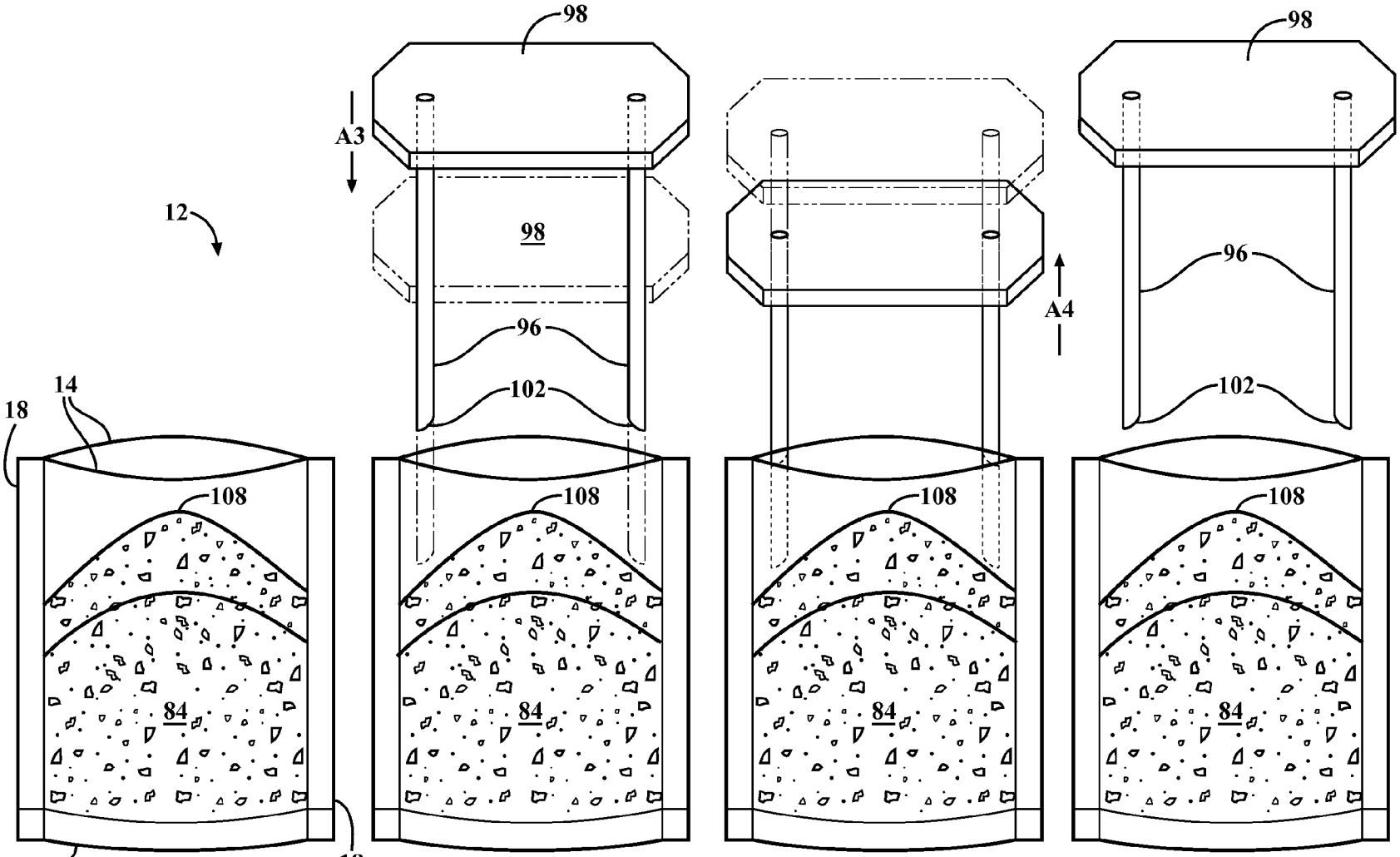
FIGS. 9A-9D are front elevational views of the second filling and second gas purging operations.

The vertical lifting mechanism 100 reciprocatingly moves the second pair of gas lances 96 between an inserted position, as best seen in FIG. 9C and a withdrawn position as best seen in FIGS. 7 and 8D. In the inserted position the outlets 102 are positioned a predetermined distance above the first amount of product 84, and in the withdrawn position the outlets 82 of the first pair of gas lances 76 are positioned above the top end 14 of the pouches 12. A second controller 94 in communication with the vertical lifting mechanism 100 controls the discharge pressure of the purging gas relative to the position of the second pair of gas lances 96 and the pouch 12.

Upon rotation of the pouches 12 into the second gas purging station 34, the second pair of gas lances 96 are positioned above the top end 14 of the pouches 12 in the withdrawn position. The second pair of gas lances 96 descend into the pouch 12 to the inserted position and ascend back to the withdrawn position while performing a purging operation, described in greater detail below. After the second purging operation is completed, with the second pair of gas lances 96 in the withdrawn position, the pouches 12 within the gripper pairs 210 are rotated to the sealing station 36 by rotation of the rotating turret 20 by the motor M.

At the sealing station 36, a conventional sealing apparatus 104 is used to seal the top end 14 of the pouches 12. The sealing apparatus 104 is optionally an ultrasonic seal or a heat seal. Upon sealing, the pouches 12 rotate to the discharge station 38. The pouches 12 at the discharge station 38 may optionally undergo a second seal such as a cosmetic cool seal. The pouches may also be cooled prior to discharge onto a transfer mechanism 42 located adjacent the discharge station 38 to receive the filled and sealed pouches 12 when they are released by the gripper pairs 210. The transfer mechanism 42 transfers the pouches 12 out for packaging and shipping.

The rotating turret 20 further includes a reject pouch/maintenance station 40 in which pouches 12 which fail inspection are not discharged at the station 38 and rotate to the reject/maintenance station 40. The pouches 12 that are rejected are then disposed of accordingly and are not sent by the transfer mechanism 42 to shipment and packaging. The rejected pouches 12 are determined by a sensor 106 located at the discharge station 40. The sensor 106 is optionally an optical sensor which verifies that the pouches 12 have been correctly sealed. In the alternative, the sensor 106 senses the weight of the pouches to determine that the pouches 12 have been correctly filled.

It is appreciated, of course, that each gripper cassette 200 is independently dischargeable from the rotating turret 20 allowing for easy maintenance and repair on individual gripper cassettes 200 including the gripper pairs 210. Specifically, maintenance/repair station 40 is the repair/maintenance station which allows for an assembly team member to discharge the gripper cassette 200 from the rotating turret 20 without interfering from the various operations of the fill-seal apparatus 10. In addition, the individual gripper cassettes 200 can be replaced entirely to reduce the amount of down or repair time on the fill-seal apparatus 10.

With reference to FIGS. 8A-D, 9A-D, a detailed description of the two part filling and purging operations will now be described. At the first filling station 30, the product 84 is entered into the open top ends 14 of the pouches 12. As best seen in FIGS. 8A-D, upon entering the pouch 12 the product 84 stacks in a triangular shape so as to provide an apex 108. The first pair of gas lances 76 are provided so as to extend parallel and are spaced apart a distance less than a distance between the side edges 18 of the pouch 12. Such a configuration allows each one of the first pair of gas lances 76 to extend parallel with and adjacent to one of the side edges 18 of the pouch 12. This allows the first pair of gas lances 76 to extend below the apex 108 of the product 84 such that in the inserted position each one of the first pair of gas lances 76 is disposed between one of the side edges 18 and the apex 108 of the product 84, as best seen in FIG. 8C. The distal ends of the first pair of gas lances 76 are optionally slanted in order to avoid contact with the product 84. The second pair of gas lances 96 have a similar structural configuration to the first pair of gas lances 76.

Figure 10B:
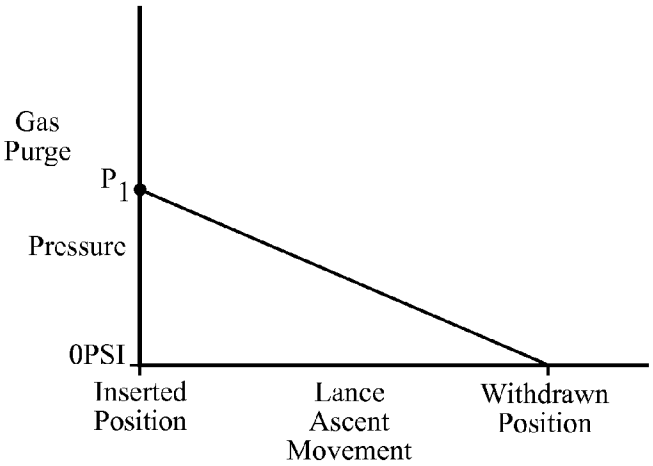
FIGS. 10A and 10B are a graphical representation relation of the purging pressure during the movement of the gas lances at the first gas purging station.
Figure 10A:
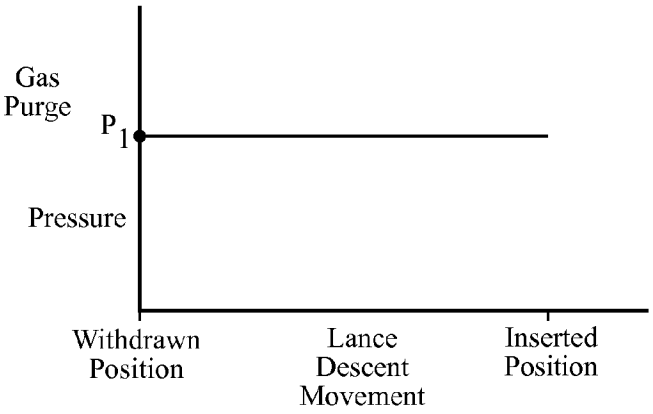

After receiving the first amount of product dispensed by the first feeder 48, as best seen in FIG. 8A, the pouches 12 are transferred to the first purging station 30. At the first purging station 30, the first pair of gas lances 76 are initially in the withdrawn position as illustrated in solid in FIG. 8B. The lifting mechanism 80 begins to vertically displace the carrier 78 and the first pair of gas lances 76 from the withdrawn position towards the inserted position (shown in ghost) in the direction of arrow A1. As the distal ends of the first pair of gas lances 76 descend pass the top end 14 of the pouch 12, the controller 86 controls the first regulator 74 to discharge a first descent pressure from the gas supply 72 so that the outlets 82 of the first pair of gas lances 76 discharge the purging gas into the pouch 12 at the first descent pressure. With reference to FIG. 10A, the first descent pressure is a pressure P1 that remains constant during the first pair of gas lance descent movement from the withdrawn position to the inserted position. The first descent pressure P1 is a high pressure in the range of 90-75 psi.

Upon reaching the inserted position, the vertical lifting mechanism 80 begins to vertically displace the carrier 78 and the first pair of gas lances 76 from the inserted position towards the withdrawn position in the direction of arrow A2, as best seen in FIG. 8C. As the first pair of lances 76 begin to move from the inserted position towards the withdrawn position the controller 86 controls the first regulator 74 to discharge a first ascent pressure from the gas supply 72 so that the outlets 82 of the first pair of gas lances 76 discharge the purging gas into the pouch 12 at the first ascent pressure. With reference to FIG. 10B, the first ascent pressure is tapered in an inverse relationship to the depth of the first pair of gas lances 76. Specifically, the first ascent pressure is reduced from the first descent pressure P1 to a zero pressure as the first pair of gas lances 76 move from the inserted position to the withdrawn position such that the first ascent pressure is generally equal to zero as the outlets 82 ascend past the top end 14 of the pouch 12.

By gradually reducing the first ascent pressure from the first descent pressure to a zero pressure reduces the turbulent mixing of the purging gas and the residual oxygen which would prevent the residual oxygen from being purged from the pouch 12. In addition, the reduction in the first ascent pressure as the first pair of gas lances are vertically displaced from the inserted position towards the withdrawn position reduces the amount of product 84 that is discharged out of the pouch 12 during the purging operation. As seen in FIGS. 10A and 10B, the first descent pressure is higher than the first ascent pressure as the first ascent pressure is reduced as the first pair of gas lances 76 are displaced from the inserted position to the withdrawn position. The first purging operation performed at the first purging station 30 purges the residual oxygen level within the pouch 12 from about 23-20% residual oxygen to about 8-2% residual oxygen.

Figure 11B:
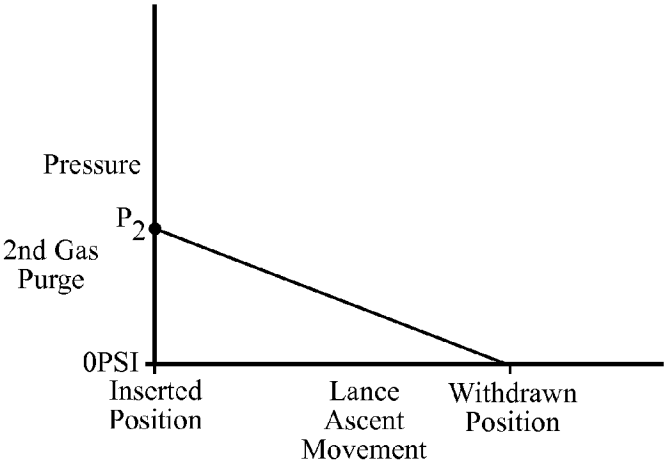
FIGS. 11A and 11B are a graphical representation relation of the purging pressure during the movement of the gas lances at the second gas purging station.
Figure 11A:
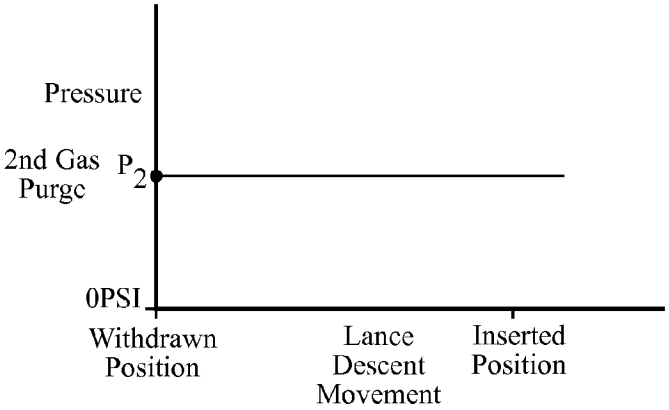

Upon completion of the first purging operation at the first purging station 30, the pouches 12 are transferred to the second filling station 32. After receiving the second amount of product dispensed by the second feeder 88, as best seen in FIG. 9A, the pouches 12 are transferred to the second purging station 34, as seen in FIG. 9B. At the second purging station 34, the second pair of gas lances 96 are initially in the withdrawn position as illustrated in solid in FIG. 9B. The second lifting mechanism 100 begins to vertically displace the second carrier 98 and the second pair of gas lances 96 from the withdrawn position towards the inserted position (shown in ghost) in the direction of arrow A3. As the distal ends, specifically the outlets 102, of the second pair of gas lances 96 descend pass the top end 14 of the pouch 12, the second controller 94 controls the second regulator 92 to discharge a second descent pressure from the second gas supply 90 so that the outlets 102 of the second pair of gas lances 96 discharge the purging gas into the pouch 12 at the second descent pressure. With reference to FIG. 11A, the second descent pressure is a pressure P2 that remains constant during the second pair of gas lance descent movement from the withdrawn position to the inserted position. The second descent pressure P2 is a low pressure in the range of 75-60 psi.

Upon reaching the inserted position, the second vertical lifting mechanism 100 begins to vertically displace the second carrier 98 and the second pair of gas lances 96 from the inserted position towards the withdrawn position in the direction of arrow A4, as best seen in FIG. 9C. As the second pair of lances 96 begin to move from the inserted position towards the withdrawn position the second controller 94 controls the second regulator 92 to discharge a second ascent pressure from the second gas supply 90 so that the outlets 102 of the second pair of gas lances 96 discharge the purging gas into the pouch 12 at the second ascent pressure. With reference to FIG. 11B, the second ascent pressure is tapered in an inverse relationship to the depth of the second pair of gas lances 96. Specifically, the second ascent pressure is reduced from the second descent pressure P2 to a zero pressure as the second pair of gas lances 96 move from the inserted position to the withdrawn position such that the second ascent pressure is generally equal to zero as the outlets 102 ascend past the top end 14 of the pouch 12.

By gradually reducing the second ascent pressure from the second descent pressure to a zero pressure reduces the turbulent mixing of the purging gas and the residual oxygen which would prevent the residual oxygen from being purged from the pouch 12. In addition, the reduction in the second ascent pressure as the second pair of gas lances 96 are vertically displaced from the inserted position towards the withdrawn position reduces the amount of product 84 that is discharged out of the pouch 12 during the purging operation. As seen in FIGS. 11A and 11B, the second descent pressure is higher than the second ascent pressure as the second ascent pressure is reduced as the second pair of gas lances 96 are displaced from the inserted position to the withdrawn position. The second purging operation performed at the second purging station 34 purges the residual oxygen level within the pouch 12 from about 8-2% residual oxygen to about 1-0.5% residual oxygen.

Moreover, as the first descent pressure is provided at a higher pressure than the second descent pressure due to the pouches 12 have both the first and the second amount of product 84 at the second purging station 34. Further, at the second purging station 34 the second pair of gas lances 96 do not descend as far into the pouches 12 as the first pair of gas lances 76 due to the increase in the amount of product 84 within the pouch at the second purging station 34.

In the alternative, the first purging station 30 and the second purging station 34 optionally share a single gas supply and a single regulator. The differences between the pressures at the first purging station 30 and the second purging station 34 are set by the diameter of the outlets 82 of the first pair of gas lances 76 and the outlets 102 of the second pair of gas lances 96. Specifically, as the first purging pressure is higher than the second purging pressure, the diameter of the outlets 82 of the first pair of gas lances 76 is less than the diameter of the outlets 102 of the second pair of gas lances 96.

In addition, either the first purging station 30, the second purging station 34 or both optionally includes a tensioner mechanism. The tensioner mechanism is controlled so as to apply a tension to the side edges 18 of the top end 14 of the pouches 12 as the first pair of gas lances 76, the second pair of gas lances 96, or both are moved from the inserted position towards the withdrawn position. The tensioner mechanism is configured so as to pull the top end 14 of the pouches 12 taut just as the first pair of gas lances 76 or the second pair of gas lances 96 are ascending passed the top end 14 of the pouches 12. By pulling the top end 14 of the pouches 12 taut as the gas lances are ascending out of the pouches 12 while the ascending pressure is being reduced to a zero pressure allows the purging stations to increase the amount of residual oxygen is purged as pulling the top end 14 of the pouches 12 taut closes the top end thereby preventing additional oxygen from entering the pouch 12.

Figure 12:
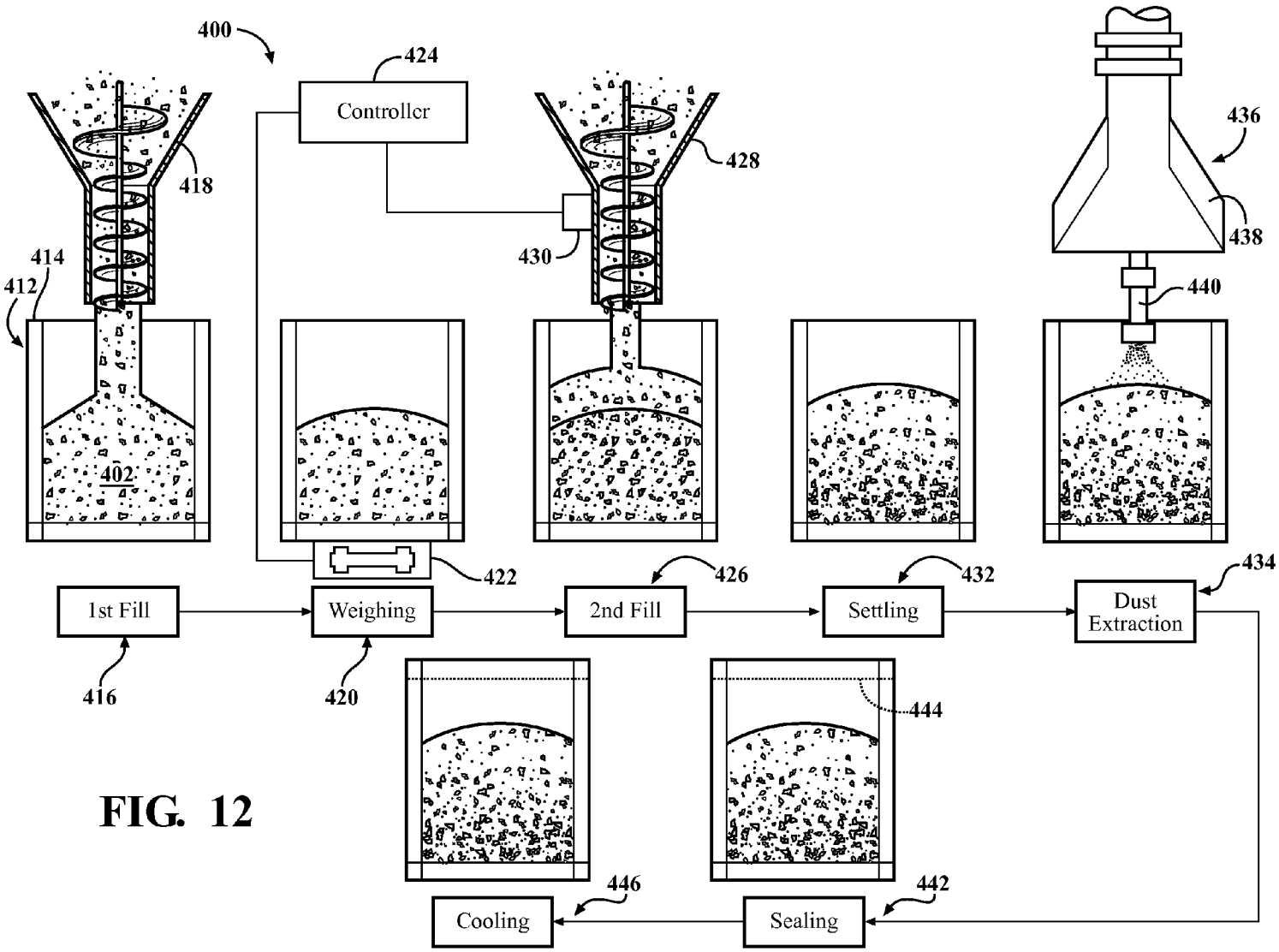
FIG. 12 is a schematic view illustrating a second embodiment of the two part filling apparatus and method.

With reference to FIG. 12, a second embodiment of the two part filling apparatus and method will now be described which utilizes a weighing station and dust extraction station rather than the first and second purging stations. FIG. 12 illustrates a schematic illustration of a fill-seal apparatus 400, in either a rotary or linear formation (each capable of operating with multiple pouches at each station). The apparatus 400 is particularly configured for use with a product 402, particularly a powder or particulate, is filled in a two stage operation.

The apparatus is configured to receive flexible pouches 412 at a conventional loading station in which the pouches 412 are loaded into grippers or holders used to transfer the pouches 412 through the station of the apparatus 400. The apparatus 400 optionally includes an opening station such as a gas knife, diving nozzle, or both to open the top ends 414 of the flexible pouch 412.

The apparatus 400 includes a first filling station 416 in which a first filler 418, such as an electronically controlled auger, directs a first amount of product into the pouch 412 through the open top side 414. The first filler 418 is connected to a hopper filled with a supply of the powder product 402. After receiving the first amount of product at the first filling station 416, the pouch 412 is transferred to a weighing station 420.

The weighing station 420 includes a scale 422 that is in communication with a controller 424 having a Computer Processing Unit (CPU), Random Access Memory (RAM), and Memory. Upon arriving at the weighing station 420 the scale 422 weighs the pouch 412 to determine a weight of the first amount of product dispensed by the first filler 418 at the first filling station 416. The scale 422 transmits the detected weight to the controller 424 which compares the detected weight of the first amount of product to a predetermined weight to determine a remaining weight of product. The predetermine weight being the final amount or weight of product 402 that is to be dispensed into the pouch 412.

After the weighing operation is completed, the pouch 412 is transferred to a second filling station 426 having a second filler 428 operable to dispense a second amount of product. The second filler 428 is optionally an electronically controller auger having a receiver 430 in communication with the controller 424. The controller 424 includes a preloaded map stored in the memory that is operable to convert the remaining weight of product into a calculated amount of time. The calculated amount of time being the amount of time to actuate the second filler 428 so as to dispense the remaining amount as the second amount of product. The controller 424 transmits the calculated amount of time to the receiver 430 which actuates the second filler 428 to operate for the calculated amount of time so as to dispense the remaining amount of product 402. As the remaining amount of product is the difference between the detected weight of the first amount of product weighed by the scale 422 and the predetermined amount of product, which is the total amount of product 402 to be dispensed into pouch 412, the apparatus accurately fills the pouch 412 with the total amount of product 402.

As such, even if the first filler 418 at the first filling station 416 is dispenses an incorrect amount of product 402, by weighing the first amount of product prior to dispensing the second amount of product, discrepancies and variances in the first amount of product can be corrected in order to accurately fill the pouch with the predetermined amount of product.

The second filler 428 is preferably an auger similar to the first filler 418; however, the second filler 428 is optionally a different type of filler, such as a funnel and a dispenser. In addition, the second filler 428 is of a smaller size so as to allow the second filler 428 to be more precise. Accordingly, the amount of product 402 in the first amount of product delivered by the first filler 418 is more than the second amount of product filled by the second filler 428. For example, the first amount of product filled by the first 418 114 is typically between 70-80% of the predetermined total amount of product, thus allowing the second filler 428 to be a slower and more accurate filler. The slower speed of the second filler 428 reduces the amount of the powdered product 402 which becomes airborne during the filling process. Further, the smaller size of the second filler 428 allows for increase in accuracy in delivering the second amount of product thereby decreasing the number of pouches 412 rejected for incorrect weight. For example, the two part filling process for the powdered product 102 allows for higher fill speeds from 60 ppm (pouches per minute) to 90 ppm without leaks caused by airborne product dust.

In addition, the measurements determined by the scale 422 are optionally used to provide feedback to the first filler 418 by varying the operating instructions sent by the CPU to increase the accuracy of the first filler 418 such that the first amount of product 402 that enters the pouch 412 becomes more precise. In such an embodiment, the first filler 418 is in communication with the controller 424 so as to receive feedback form the scale 422, and the controller 424 includes a first filler map that converts amounts or weight of product 402 into operating time for the first filler 418. For example, if the scale 422 determines that the weight of the product 402 within the pouch 412 is less than the predetermined first amount of product that the first filler 418 was set to deliver, then the controller 424 will vary the operating instructions to increase the length of operation of the first filler 418. In the alternative, if the scale 422 determines that the weight of the product 402 within the pouch 412 is more than the predetermined first amount of product that the first filler 418 was set to deliver, then the controller will vary the operating instructions to decrease the length of operation of the first filler 418.

After the pouch 412 has received the second amount of product at the second filing station 426, the pouch 412 is transferred to a settling station 432 in which any of the airborne product 432 within the pouch 412 is given a chance to settle. The settling station 432 optionally includes a settling mechanism that tap the top end 414 or the bottom end of the pouch 412 to remove any particulate product 402 from the top end 414 so as to avoid containments that can degrade the sealing of the top ends 414. The pouch 412 then proceeds to a dust extraction station 434, where the remaining airborne particles are extracted by a suction unit 436, such as a vacuum. The suction unit 436 optionally includes a hood unit 438 which is dimensioned to cover the top end 414 of the pouch 412. In addition, the vacuum unit 436 optionally includes a suction nozzle 440 which extends into the pouch 412 through the top end 414. The suction nozzle 440 extracts the airborne particulate remaining within the pouch 412.

Once the pouches 412 have undergone dust extraction at the dust extraction station 434, the pouches 412 proceed to a sealing station 442 where a seal 444 is provided along the top end 414 of the pouch 412 in order to seal the product 402 within the pouch 412. The seal is optionally an ultrasonic seal which provides a higher bonding of the top ends 414 when the product 402 is a particulate. As the pouches 412 have undergone dust extraction prior to sealing, the leaks caused by imperfections in the seals 444 due to contaminates (airborne particulates and product dust) are significantly reduced. After sealing, the pouches 412 proceed to a cooling station 446 where the seal is given time to cool prior to discharge from the apparatus 100.

It will be appreciated, of course, that apparatus 10 and apparatus 400 are both useable in a rotary or inline formation. Further, each of the apparatuses in either formation allows for the two part filling of multiple pouches across multiple lanes as each apparatus is capable of carrying out the operation of each station on multiple pouches simultaneously.

It is appreciated, of course, that many modifications and variations of the present invention are possible in light of the above teachings and may be practiced other than as specifically described.

It is claimed:

1. An apparatus for the filling of a flexible pouch with a product, said pouch having a bottom end, an opposite top end, and a pair of side edges extending between said top end and said bottom end, said apparatus comprising:

a filling station having a feeder that dispenses an amount of product into said pouch, said feeder configured to dispense the product into the pouch such that the product stacks with a triangular shape so as to provide an apex;

a supply of compressed purging gas; and a gas purge station positioned subsequent to said filling station, said gas purge station having only one pair of gas lances operatively connected to said supply of purging gas, each one of said pair of gas lances having an outlet at a distal end to discharge said purging gas into said pouch, said pair of gas lances reciprocatingly moveable between an inserted position and a withdrawn position, said pair of gas lances extend parallel and spaced apart a distance in said inserted position and said same distance in said withdrawn position, said distance less than a distance between said pair of side edges of said pouch, said pair of gas lances in said inserted position being within said pouch, each one of said pair of gas lances in said inserted position being disposed adjacent and spaced apart from one of said pair of side edges of said pouch such that there is a space between each one of said pair of gas lances to permit accumulation of the product having the apex and in which each one of said pair of gas lances in said inserted position is disposed between one of said side edges of said pouch and the product, below the apex of the product, without contacting the product, and said pair of gas lances in said withdrawn position being disposed above said top end of said pouch.

2. The apparatus of claim 1 further comprising:

a gas pressure regulator that regulates a pressure of the compressed gas discharged from said pair of gas lances; and a controller operatively connected to said gas pressure regulator, said controller configured to control said gas pressure regulator such that upon movement from said withdrawn position to said inserted position said pair of gas lances discharges a descent pressure and upon movement from said inserted position to said withdrawn position said pair of gas lances discharges an ascent pressure, said descent pressure being different than said ascent pressure.

3. The apparatus of claim 2, wherein one of said descent pressure and said ascent pressure is a constant pressure and said other of said descent pressure and said ascent pressure is regulated to vary with a depth of said pair of gas lances.

4. The apparatus of claim 3, wherein said descent pressure being greater than said ascent pressure, and wherein said ascent pressure is reduced from said descent pressure at said inserted position to a zero pressure at said withdrawn position.

5. The apparatus of claim 1 further comprising:

a second filling station having a second feeder that dispenses a second amount of product into said pouch, said second filling station positioned subsequent to said gas purge station; and a second gas purge station positioned subsequent to said second filling station, said second gas purge station having only one pair of second gas lances operatively connected to said supply of purging gas, each one of said pair of second gas lances having an outlet at a distal end to discharge said purging gas into said pouch, said pair of second gas lances reciprocatingly moveable between an inserted position and a withdrawn position, said pair of second gas lances in said inserted position being within said pouch, and said pair of second gas lances in said withdrawn position being disposed above said top end of said pouch.

6. The apparatus of claim 5, wherein each one of said pair of second gas lances in said inserted position being disposed adjacent one of said pair of side edges of said pouch.

7. The apparatus of claim 6, wherein said pair of second gas lances extend parallel and spaced apart a distance less than a distance between said pair of side edges of said pouch.

8. The apparatus of claim 7, wherein each one of said pair of second gas lances in said inserted position is disposed between one of said side edges of said pouch and an apex of said product.

9. The apparatus of claim 8 further comprising:

a second gas pressure regulator that regulates a pressure of the compressed gas discharged from said pair of second gas lances, wherein said controller is operatively connected to said second gas pressure regulator, said controller configured to control said second gas pressure regulator such that upon movement from said withdrawn position to said inserted position said pair of second gas lances discharges a second descent pressure and upon movement from said inserted position to said withdrawn position said pair of second gas lances discharges a second ascent pressure, and wherein said second descent pressure being different than said second ascent pressure.

10. The apparatus of claim 9, wherein said descent pressure is greater than said second descent pressure.

11. An apparatus for the filling of a flexible pouch with a product, said pouch having a bottom end, an opposite top end, and a pair of side edges extending between said top end and said bottom end, said apparatus comprising:

a filling station having a feeder that dispenses an amount of product into said pouch;

a supply of compressed purging gas;

a gas purge station positioned subsequent to said filling station, said gas purge station having a pair of gas lances operatively connected to said supply of purging gas, each one of said pair of gas lances having an outlet at a distal end to discharge said purging gas into said pouch, said pair of gas lances reciprocatingly moveable between an inserted position and a withdrawn position, said pair of gas lances in said inserted position being within said pouch, each one of said pair of gas lances in said inserted position being spaced apart from one of said pair of side edges of said pouch, and said pair of gas lances in said withdrawn position being disposed above said top end of said pouch;

a second filling station having a second feeder that dispenses a second amount of product into said pouch, said second filling station positioned subsequent to said gas purge station, said second feeder configured to dispense the product into the pouch such that the product stacks with a triangular shape so as to provide an apex; and a second gas purge station positioned subsequent to said second filling station, said second gas purge station having only one pair of second gas lances operatively connected to said supply of purging gas, each one of said pair of second gas lances having an outlet at a distal end to discharge said purging gas into said pouch, said pair of second gas lances reciprocatingly moveable between an inserted position and a withdrawn position, said pair of second gas lances extend parallel and spaced apart a distance in said inserted position and said same distance in said withdrawn position, said distance less than a distance between said pair of side edges of said pouch, said pair of second gas lances in said inserted position being within said pouch, each one of said pair of second gas lances in said inserted position being disposed adjacent and spaced apart from one of said pair of side edges of said pouch such that there is a space between each one of said pair of second gas lances to permit accumulation of the product having the apex and in which each one of said pair of second gas lances in said inserted position is disposed between one of said side edges of said pouch and the product, below the apex of the product, without contacting the product, and said second pair of second gas lances in said withdrawn position being disposed above said top end of said pouch.

12. The apparatus of claim 11 further comprising:

a gas pressure regulator that regulates a pressure of said compressed gas discharged by said pair of gas lances; and a controller operatively connected to said gas pressure regulator, said controller configured to control said gas pressure regulator such that upon movement from said withdrawn position to said inserted position said pair of gas lances discharges a descent pressure and upon movement from said inserted position to said withdrawn position said pair of gas lances discharges an ascent pressure, and wherein said descent pressure being different than said ascent pressure.

13. The apparatus of claim 12 further comprising:

a second gas pressure regulator that regulates a pressure of the compressed gas discharged from said pair of second gas lances, wherein said controller is operatively connected to said second gas pressure regulator, said controller configured to control said second gas pressure regulator such that upon movement from said withdrawn position to said inserted position said pair of second gas lances discharges a second descent pressure and upon movement from said inserted position to said withdrawn position said pair of second gas lances discharges a second ascent pressure, and wherein said second descent pressure being different than said second ascent pressure.

14. The apparatus of claim 13, wherein one of said descent pressure and said ascent pressure is a constant pressure and said other of said descent pressure and said ascent pressure is regulated to vary with a depth of said pair of gas lances, wherein one of said second descent pressure and said second ascent pressure is a constant pressure and said other of said second descent pressure and said second ascent pressure is regulated to vary with a depth of said pair of second gas lances.

15. An apparatus for the filling of a flexible pouch with a product, said pouch having a bottom end, an opposite top end, and a pair of side edges extending between said top end and said bottom end said apparatus comprising:

a filling station having a feeder that dispenses an amount of product into said pouch;

a supply of compressed purging gas;

a gas purge station positioned subsequent to said filling station, said gas purge station having a pair of gas lances operatively connected to a gas pressure regulator to connect said pair of gas lances to said supply of purging gas, each one of said pair of gas lances having an outlet at a distal end to discharge said purging gas into said pouch, said pair of gas lances reciprocatingly moveable between an inserted position and a withdrawn position, said pair of gas lances extend parallel and spaced apart a distance less than a distance between said pair of side edges of said pouch, said pair of gas lances in said inserted position being within said pouch, each one of said pair of gas lances in said inserted position being disposed adjacent and spaced apart from one of said pair of side edges of said pouch, and said pair of gas lances in said withdrawn position being disposed above said top end of said pouch;

said gas pressure regulator regulates a pressure of the compressed gas discharged from said pair of gas lances; and a controller operatively connected to said gas pressure regulator, said controller configured to control said gas pressure regulator such that upon movement from said withdrawn position to said inserted position said pair of gas lances discharges a descent pressure and upon movement from said inserted position to said withdrawn position said pair of gas lances discharges an ascent pressure, said descent pressure being different than said ascent pressure.

16. The apparatus of claim 15, wherein said descent pressure being greater than said ascent pressure.

17. The apparatus of claim 15, wherein one of said descent pressure and said ascent pressure is a constant pressure and said other of said descent pressure and said ascent pressure is regulated to vary with a depth of said pair of gas lances.

18. The apparatus of claim 15 further comprising:

a second filling station having a second feeder that dispenses a second amount of product into said pouch, said second filling station positioned subsequent to said gas purse station;

a second gas purse station positioned subsequent to said second filling station, said second gas purse station having a pair of second gas lances operatively connected to said supply of purging gas, each one of said second pair of second gas lances having an outlet to discharge said purging gas into said pouch, said pair of second gas lances reciprocatingly moveable between an inserted position and a withdrawn position;

a second gas pressure regulator that regulates a pressure of the compressed gas discharged from said pair of second gas lances, wherein said controller is operatively connected to said second gas pressure regulator, said controller configured to control said second gas pressure regulator such that upon movement from said withdrawn position to said inserted position said pair of second gas lances discharges a second descent pressure and upon movement from said inserted position to said withdrawn position said pair of second gas lances discharges a second ascent pressure, and wherein said second descent pressure being different than said second ascent pressure.

19. The apparatus of claim 18, wherein one of said second descent pressure and said second ascent pressure is a constant pressure and said other of said second descent pressure and said second ascent pressure is regulated to vary with a depth of said pair of gas lances.

20. The apparatus of claim 19, wherein one of said descent pressure and said ascent pressure is a constant pressure and said other of said descent pressure and said ascent pressure is regulated to vary with a depth of said pair of gas lances.

* * * * *